US005819966A

United States Patent [19]

Ota et al.

[11] Patent Number: 5,819,966

[45] Date of Patent: Oct. 13, 1998

[54] SYNTHETIC RESIN BOTTLE WITH GRIP

[75] Inventors: Akiho Ota, Tokyo; Takao Iizuka, Matsudo, both of Japan

[73] Assignee: Yoshino Kogyosho Co., Ltd., Tokyo, Japan

[21] Appl. No.: 699,784

[22] Filed: Aug. 20, 1996

[51] Int. Cl.[6] ..... B65D 23/10

[52] U.S. Cl. ..... 215/398

[58] Field of Search ..... 215/396, 398

[56] References Cited

U.S. PATENT DOCUMENTS

| | | | |
|---|---|---|---|
| 3,140,329 | 7/1964 | Nutting . | |
| 4,257,525 | 3/1981 | Thompson . | |
| 4,273,246 | 6/1981 | Thompson . | |
| 4,281,770 | 8/1981 | Rainville . | |
| 4,363,415 | 12/1982 | Rainville . | |
| 4,629,598 | 12/1986 | Thompson . | |
| 4,727,997 | 3/1988 | Nakamura et al. . | |
| 4,909,978 | 3/1990 | Hasegawa et al. . | |
| 4,915,241 | 4/1990 | Morimura et al. . | |
| 4,952,133 | 8/1990 | Hasegawa et al. . | |
| 4,964,522 | 10/1990 | Umetsu et al. . | |
| 5,092,476 | 3/1992 | Yasuda et al. . | |
| 5,167,970 | 12/1992 | Yoshino et al. . | |
| 5,297,686 | 3/1994 | Takeuchi . | |
| 5,338,503 | 8/1994 | Yanagisawa et al. . | |
| 5,469,612 | 11/1995 | Collette et al. | 215/396 X |
| 5,535,901 | 7/1996 | Ishii et al. . | |
| 5,560,506 | 10/1996 | Yanagisawa . | |

FOREIGN PATENT DOCUMENTS

| | | |
|---|---|---|
| 650900-A1 | 5/1995 | European Pat. Off. . |
| 889343 | 2/1962 | United Kingdom . |

*Primary Examiner*—Jes F. Pascua
*Attorney, Agent, or Firm*—Oliff & Berridge, PLC

[57] ABSTRACT

The present invention provides a bottle with a grip that can effectively prevent cracks from being produced along the connecting portion of the bottle main body and the grip, and prevent flexural deformation from occurring as much as possible to make the grip firmly and stably secured to the bottle main body. The bottle comprises a biaxially oriented blow-molded bottle main body and a grip which includes upper and lower securing plates and a securing beam plate which are used as as insertion members. The front ends of the upper and lower securing plates are firmly held in position relative to each other by the securing beam panel so as to prevent cracks from being produced in the bottle main body. The securing beam plate is provided with a projection that makes the grip unremovably, undisplacably and hence stably secured to the bottle main body.

32 Claims, 11 Drawing Sheets

SYNTHETIC RESIN BOTTLE WITH GRIP

FIELD OF THE INVENTION

This invention relates to a synthetic resin bottle with a grip comprising a bottle main body formed by biaxially oriented blow molding and a grip which is separately molded and used as an insertion member.

BACKGROUND OF THE INVENTION

Japanese Utility Model Laid-open No. 63-147429 discloses a known typical large synthetic resin bottle comprising a molded bottle main body and a separately molded grip which is subsequently and securely fitted to the main body.

More specifically, the main body of the prior art bottle is provided on the backside of the body section thereof with a vertically running arcuate recess having a longitudinal arcuate engaging projection formed at the center thereof to produce a pair of long lateral arcuate grooves running vertically with closed opposite ends. The separately molded grip is realized in the form of a framework having a frontal arcuate frame member and a grip member connecting and suspended by the upper and lower ends of the frontal arcuate frame member. Said frontal arcuate frame member is provided on the lateral sides thereof with engaging ridges, so that the grip comes to be unremovably secured to the bottle main body as the framework is pressed against the recess of the bottle main body from the backside until the engaging ridges of the grip is forced to override the portion of the wall of the bottle main body that carries thereon the long arcuate grooves.

FIG. 18 of the accompanying drawings illustrates another prior art bottle comprising a bottle main body formed by biaxially oriented blow molding and a grip operating as an insertion member and designed to provide an improved engagement with the bottle main body.

The prior art bottle illustrated in FIG. 18 comprises a synthetic resin bottle main body 1 formed by biaxially oriented blow molding and a C-shaped grip 11 having an upper securing plate 13 and a lower securing plate 14, and a grip plate 12 having its upper and lower ends connected respectively to the rear end of the upper securing plate and that of the lower securing plate. The upper securing plate 13 and the lower securing plate 14 are secured respectively to the upper and lower ends of a recess 3 formed on a rear portion of the body section 2 of the bottle main body 1. An upward projection 19 is projected from the front end of the upper securing plate 13 and a downward projection 19 is projected from the front end of the lower securing plate 14.

The bottle main body 1 is formed by biaxially oriented blow molding, using the upper securing plate 13 and the lower securing plate 14 of the grip 11 of the bottle illustrated in FIG. 18 as insertion members. The bottle main body 1 is provided with an upper recess 6 having an upward engaging recess 8 for engagedly receiving the upper securing plate 13 having an upward projection 19, and a lower recess 7 having a downward engaging recess 8 for engagedly receiving the lower securing plate 14 having a downward projection 19. Since the bottle main body 1 Is blow molded, using the grip 11 as an insertion member, the grip 11 is securely fitted to the bottle main body without any shakiness.

With the above described prior art, although the grip can be firmly secured to the bottle main body, massive power and the use of specifically designed assembling equipment are required to fit the grip into the bottle main body to consequently increase the manufacturing cost.

Additionally, since the bottle main body is formed by biaxially oriented blow molding, the bottle main body has a thin wall thickness. If a force is applied to the bottle main body in order to fit the grip into it, it tends to occur faulty deformation such as buckling deformation on the part of the bottle main body so that a faulty product may be produced at the time of fitting the grip to the bottle main body.

Still additionally, since the bottle main body is formed by biaxially oriented blow molding, the bottle main body has a thin wall as described above. Thus, portions of the bottle main body engaged with the grip tends to be subject to elastic flexural deformation due to the load applied to them. Such flexural deformation may lead to a reduced engaging effect between and an eventual separation of the bottle main body and the grip.

Furthermore, the grip Is held to the bottle main body under an engaged condition only through the engagement of the long grooves and the engaging ridges, and such engagement is achieved as the engaging ridges are forced to override the portion of the wall of the bottle main body that carries thereon the long arcuate grooves. Thus, the grip tends to become shaky on the bottle main body so as to make the use of the grip unstable when handling the bottle.

Still furthermore, the bottle main body and the grip are molded separately, in other words, the bottle main body is formed by biaxially oriented blow molding, whereas the grip is formed by injection molding. Thus, the engaging sections of the bottle main body and the grip tends to show large dimensional discrepancies so as to make it difficult to secure the grip to the bottle main body without shakiness. Additionally, the projections of the engaging sections of the bottle main body cannot be made very sharp because the bottle main body is formed by biaxially oriented blow molding. Thus, the grip and the bottle main body cannot necessarily be secured very stably to each other.

When the bottle of the prior art illustrated in FIG. 18 is caused to fall with the grip 11 facing downward, cracks tend to occur on the bottle main body 1 particularly at the site where the lower securing plate 14 of the grip 11 is fitted to the bottle main body.

This is probably because the upper and lower securing plates 13 and 14 of the C-shaped grip tend to be elastically deformed to move away from each other by the impact of the fall, and the bottle main body 1 is subject to impact which is directed to separate it away from the lower securing plate 14 at the site where the lower securing plate 14 is fitted thereto so that consequently cracks are formed in the bottle main body.

SUMMARY OF THE INVENTION

In view of the above problems of the prior art, it is therefore one technological object of the present invention to provide a bottle of the type under consideration whose bottle main body is free from cracks at the sites where the grip is secured thereto if they are subjected to impact. It is also an object to provide a bottle which is free from deformation and displacement of the portions thereof where the grip is secured to it if a large load is applied thereto. It is also an object to provide stably secured grip by improving the engagement of the grip to the bottle main body.

The present invention provides a bottle with a grip that can effectively prevent cracks from being produced along the connecting portion of the bottle main body and the grip, and prevent flexural deformation from occurring as much as possible to make the grip firmly and stably secured to the bottle main body.

The bottle comprises a biaxially oriented blow-molded bottle main body and a grip which includes upper and lower securing plates and a securing beam plate which are used as as insertion members. The front ends of the upper and lower securing plates are firmly held in position relative to each other by the securing beam panel so as to prevent cracks from being produced in the bottle main body. The securing beam plate is provided with a projection that makes the grip unremovably, undisplacably and hence stably secured to the bottle main body.

According to the invention, the above technological problems are solved by providing a synthetic resin bottle-shaped container with a grip, comprising a biaxially oriented blow-molded bottle main body made of synthetic resin and a grip, wherein said bottle main body has a body section, said body section includes a recess formed by indenting a rear side of the body section, said grip comprises an upper securing plate secured to an upper portion of the recess, a lower securing plate secured to a lower portion of the recess, a grip plate connecting a rear end of the upper securing plate at an upper end thereof and a rear end of the lower securing plate at a lower end thereof, and a securing beam plate provided between a front end portion of the upper securing plate and a front end portion of the lower securing plate, the front end portion of the upper securing plate is provided with an upward projection, the front end portion of the lower securing plate is provided with a downward projection, the bottle main body is provided with an upper recess into which the upper securing plate is inserted, a lower recess into which the lower securing plate is inserted, and a central longitudinal groove engaged with the securing beam plate, said upper recess is provided with an upward engaging recess for engagedly receiving said upward projection, and said lower recess is provided with a downward engaging recess for engagedly receiving said downward projection. In the present invention, each of the upper securing plate, the lower securing plate and the securing beam plate acts as an insert.

According to another aspect of the invention, the above technological problems are also solved by providing a synthetic resin bottle-shaped container with a grip, comprising a biaxially oriented blow-molded bottle main body made of synthetic resin and a grip, wherein said bottle main body has a body section, said body section includes a recess formed by indenting a rear side of the body section, said grip comprises an upper securing plate secured to an upper portion of the recess, a lower securing plate secured to a lower portion of the recess, a grip plate connecting a rear end of the upper securing plate at an upper end thereof and a rear end of the lower securing plate at a lower end thereof, and a securing beam plate provided between a front end portion of the upper securing plate and a front end portion of the lower securing plate, the front end portion of the upper securing plate is provided with two upward projections laterally provided, the front end of the upper securing plate is provided with an upper angular piece upwardly, forwardly and obliquely projected, the front end portion of the lower securing plate is provided with two downward projections laterally provided, the front end of the lower securing plate is provided with a lower angular piece upwardly, forwardly and obliquely projected, the bottle main body is provided with an upper recess into which the upper securing plate is inserted, a lower recess into which the lower securing plate is inserted, and a central longitudinal groove engaged with the securing beam plate, said upper recess is provided with an upward engaging recess for engagedly receiving said upward projection, and an upper engaging hole for engaging the upper angular piece, said upper engaging hole being upwardly, forwardly and obliquely directed, and said lower recess is provided with a downward engaging recess for engagedly receiving said downward projection, and a lower engaging hole for engaging the lower angular piece, said lower engaging hole being upwardly, forwardly and obliquely directed.

According to still another aspect of the invention, the above technological problems are also solved by providing a synthetic resin bottle-shaped container with a grip, comprising a biaxially oriented blow-molded bottle main body made of synthetic resin and a grip, wherein said bottle main body has a body section, said body section includes a recess formed by indenting a rear side of the body section, said grip comprises an upper securing plate secured to an upper portion of the recess, a lower securing plate secured to a lower portion of the recess, a grip plate connecting a rear end of the upper securing plate at an upper end thereof and a rear end of the lower securing plate at a lower end thereof, and a securing beam plate provided between a front end portion of the upper securing plate and a front end portion of the lower securing plate, the front end portion of the upper securing plate is provided with an upward projection, the front end of the upper securing plate is provided with two upper angular pieces laterally provided, said upper angular pieces being upwardly, forwardly and obliquely directed, the front end portion of the lower securing plate is provided with a downward projection, the front end of the lower securing plate is provided with a lower angular piece directed upwardly, forwardly and obliquely, the bottle main body is provided with an upper recess into which the upper securing plate is inserted, a lower recess into which the lower securing plate is inserted, and a central longitudinal groove engaged with the securing beam plate, said upper recess is provided with an upward engaging recess for engagedly receiving said upward projection, and upper engaging holes for engagedly receiving said two upper angular pieces laterally provided, said upper engaging holes being upwardly, forwardly and obliquely directed, and said lower recess is provided with a downward engaging recess for engagedly receiving said downward projection, and a lower engaging hole for engagedly receiving said lower angular piece, said lower engaging hole being upwardly, forwardly and obliquely directed.

According to a further aspect of the invention, the above technological problems are also solved by providing a synthetic resin bottle-shaped container with a grip, comprising a biaxially oriented blow-molded bottle main body made of synthetic resin and a grip, wherein said bottle main body has a body section, said body section includes a recess formed by indenting a rear side of the body section, said grip comprises an upper securing plate secured to an upper portion of the recess, a lower securing plate secured to a lower portion of the recess, a grip plate connecting a rear end of the upper securing plate at an upper end thereof and a rear end of the lower securing plate at a lower end thereof, and a securing beam plate provided between a front end portion of the upper securing plate and a front end portion of the lower securing plate, the front end portion of the upper securing plate is provided with an upward projection, the front end portion of the lower securing plate is provided with a downward projection, a front surface of the securing beam plate is provided with an engaging projection having a bulged tip section at an end thereof, the bottle main body is provided with an upper recess into which the upper securing plate is inserted, a lower recess into which the lower securing plate is inserted, and a central longitudinal groove engaged with the securing beam plate, said upper recess is provided with an upward engaging recess for engagedly receiving said upward projection, said lower recess is provided with a downward engaging recess for engagedly receiving said downward projection, and said central longitudinal groove is provided with an engaging hole for engagedly receiving said engaging projection.

Preferably, the engaging projection of the grip is inclined frontward and upward.

Preferably, the front end of the upper securing plate and that of the lower securing plate of the grip are located ahead of the suspending junctions of the securing beam plate. Alternatively, it is advantageous that at least the lower securing plate of the upper securing plate and the lower securing plate of the grip is provided on the lower surface thereof with a plurality of grooves extending longitudinally and the lower recess of the bottle main body is provided on the bottom surface thereof with ridges for engagement with said grooves.

With any of the above arrangements, the grip is securely fitted to the bottle main body in which the securing beam plate, the upper and lower securing plates of the grip come into engagement respectively with the central longitudinal groove and the upper and lower recesses of the bottle main body. Since the securing beam plate, the upper securing plate and the lower securing plate of the grip are used as insertion members for forming the central longitudinal groove, the upper recess and the lower recess at the time of producing the bottle main body by biaxially oriented blow molding, the grip is firmly and stably secured to the bottle main body without any shakiness.

Thus, since the securing beam plate, the upper and lower securing plates of the grip come into engagement respectively with the central longitudinal groove and the upper and lower recesses of the bottle main body, the grip is firmly secured to the bottle main body so as to prevent displacing of the grip relative to the bottle main body either horizontally or vertically. In addition, removal of the grip by rearward to get it out of the bottle main body is prevented.

Since the projections of the grip that come into engagement respectively with the upper and lower engaging recesses of the bottle main body are positioned or located at the upper and lower end of the grip, when the content of the bottle is poured out, the load of the bottle main body applied to the grip is supported at both the upper and lower ends of the grip, so that the grip is stably secured to the bottle main body relative to the bottle main body.

When the user picks up the bottle by holding the grip with hand, the load of the bottle main body is supported or borne by the upper securing plate. Since the upper securing plate and the lower securing plate are held by the securing beam plate in the respective recesses of the bottle main body, the upper securing plate bearing the load of the bottle main body is not deformed (its front end is not bent downwardly), so that the load of the bottle main body is stably supported by the upper securing plate.

Since the securing beam plate is suspended between the upper and lower securing plates, the upper and lower securing plates are not deformed to change the distance between the front ends thereof, Thus, if the bottle is mistakenly caused to fall down with the grip facing downward and subjected to impact, the upper ar and lower securing plates are free from deformation that can change the distance therebetween. Thus, the bottle main body is not subject to impact which is directed to separate it away from the lower securing plate at the site where the lower securing plate is fitted thereto, so that consequently cracks are not formed in the bottle main body.

An upper angular piece and a lower angular piece may be provided respectively on the upper and lower securing plates of the grip and project forwardly, upwardly and obliquely from the respective front ends of the plates The upper angular piece reinforces the anti-release effect of the upward projection of the upper securing plate. In addition, the upper angular piece reinforces the effect of the upper securing plate of bearing the load of the bottle main body. The lower angular piece reinforces the anti-release effect of the downward projection of the lower securing plate. The lower angular piece reinforces the lower securing plate to bear the load of the bottle main body. Thus, the grip can bear the load of the bottle main body at both the upper and lover ends thereof.

The engaging projection may be provided on the front surface of the securing beam plate. The engaging projection has a bulged tip section. The engaging projection has an effect similar to that of the upper and lower angular pieces and, therefore, prevents the securing beam plate from coming off from the bottle main body. Because of the engaging projection on the front surface of the securing beam plate, the securing beam plate bears the load of the bottle main body. Thus, the grip bears the load of the bottle main body evenly along its entire length.

The upward projection or the upper angular piece projecting from the upper securing plate may be laterally split into two parts. In this case, the effect of the upward projection or the upper angular piece is exerted on both of the lateral sides of the upper securing plate, so as to stabilize the anti-release effect and the effect of bearing the load of the bottle main body. It should be noted that only either the upward projection or the upper angular piece can be divided into two parts, because their mechanical strength would be reduced if the both were divided into parts. Thus, only either of them is divided into two parts in order to ensure the mechanical strength, the anti-release effect and the effect of preventing lateral displacement of the grip.

The upper angular piece may be divided into two parts. In this case, it can effectively bear the load of the bottle main body, because it is located at the front end of the upper securing plate. However, if the upper angular piece projecting forwardly, upwardly and obliquely is divided into two parts, it is required that a metal mold becomes complex in which a part for molding the upper angular piece that can be opened and closed obliquely, so that a number of grips by means of a single injection metal mold would be decreased.

The upward projection may be divided Into two parts. In this case, the injection metal mold for molding the grip may have a simple structure that requires only horizontal and vertical opening and closing operations, so that a large number of grips can be molded with a single injection metal mold to raise the productivity and reduce the cost of manufacturing grips.

This invention is effective for a heat-resistant bottle with a grip. When a hot content is filled in the bottle, the grip is not disconnected, because the securing beam plate of the grip is engaged with the central longitudinal groove of the bottle main body in addition to the engagement of the projection of the grip with the engaging recess of the bottle main body.

PREFERRED EMBODIMENT OF THE INVENTION

Now, the present invention will be described by referring to the accompanying drawings that Illustrate preferred embodiments of the invention.

Figure 1:
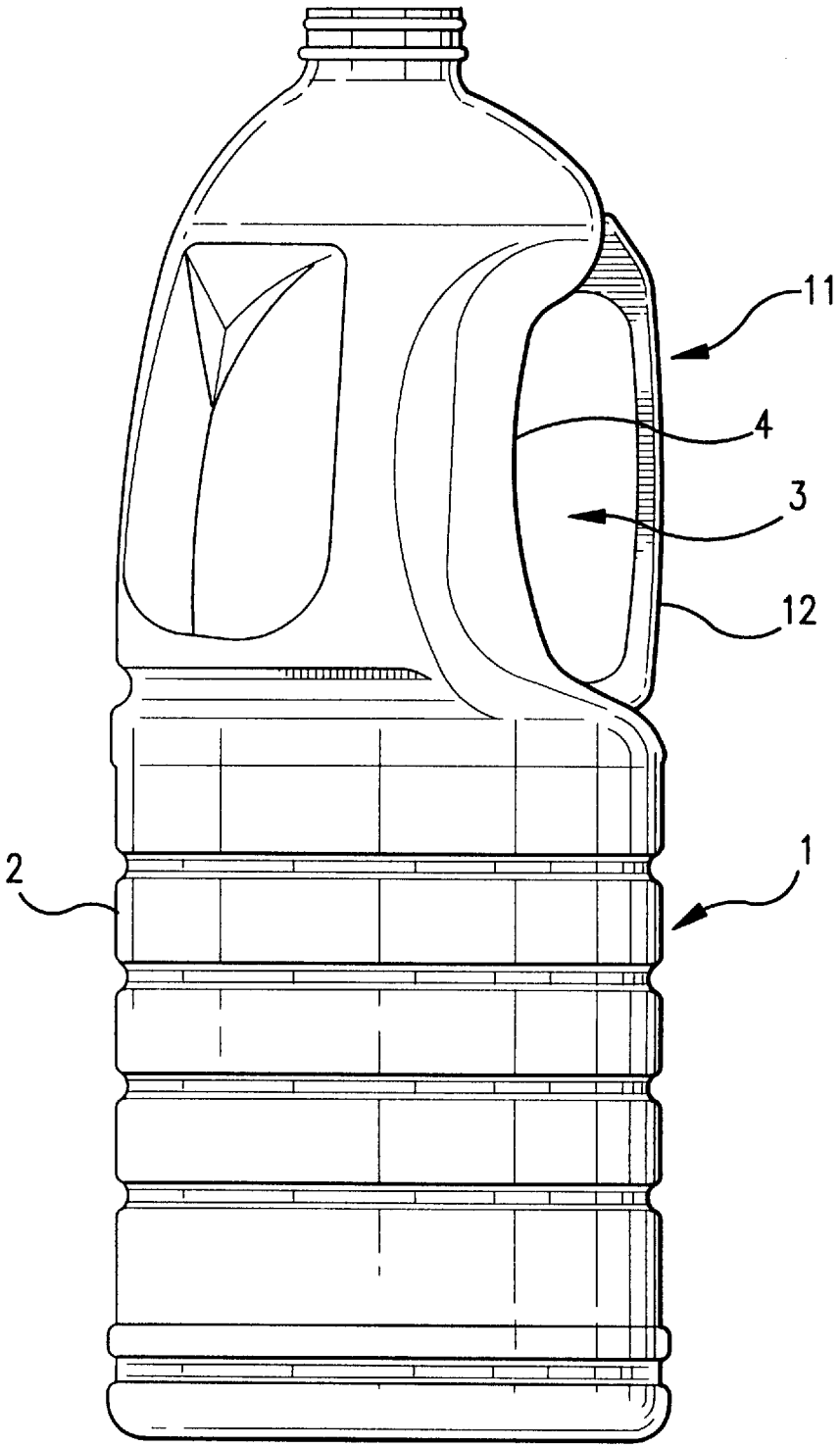
FIG. 1 is a schematic lateral view of a first embodiment of the invention.

FIG. 1 is a schematic lateral view of a first embodiment of the bottle according to the invention. A bottle main body 1 is a large body (1.0 to 4.0 liters) of polyethyleneterephthalate or a biaxially oriented blow molded bottle shaped container of polyethyleneterephthalate. The main body 1 has a body section 2 which is provided at an upper rear part thereof with a recess 3 for securely receiving a grip 11 as an insert (insertion member).

Figure 2:
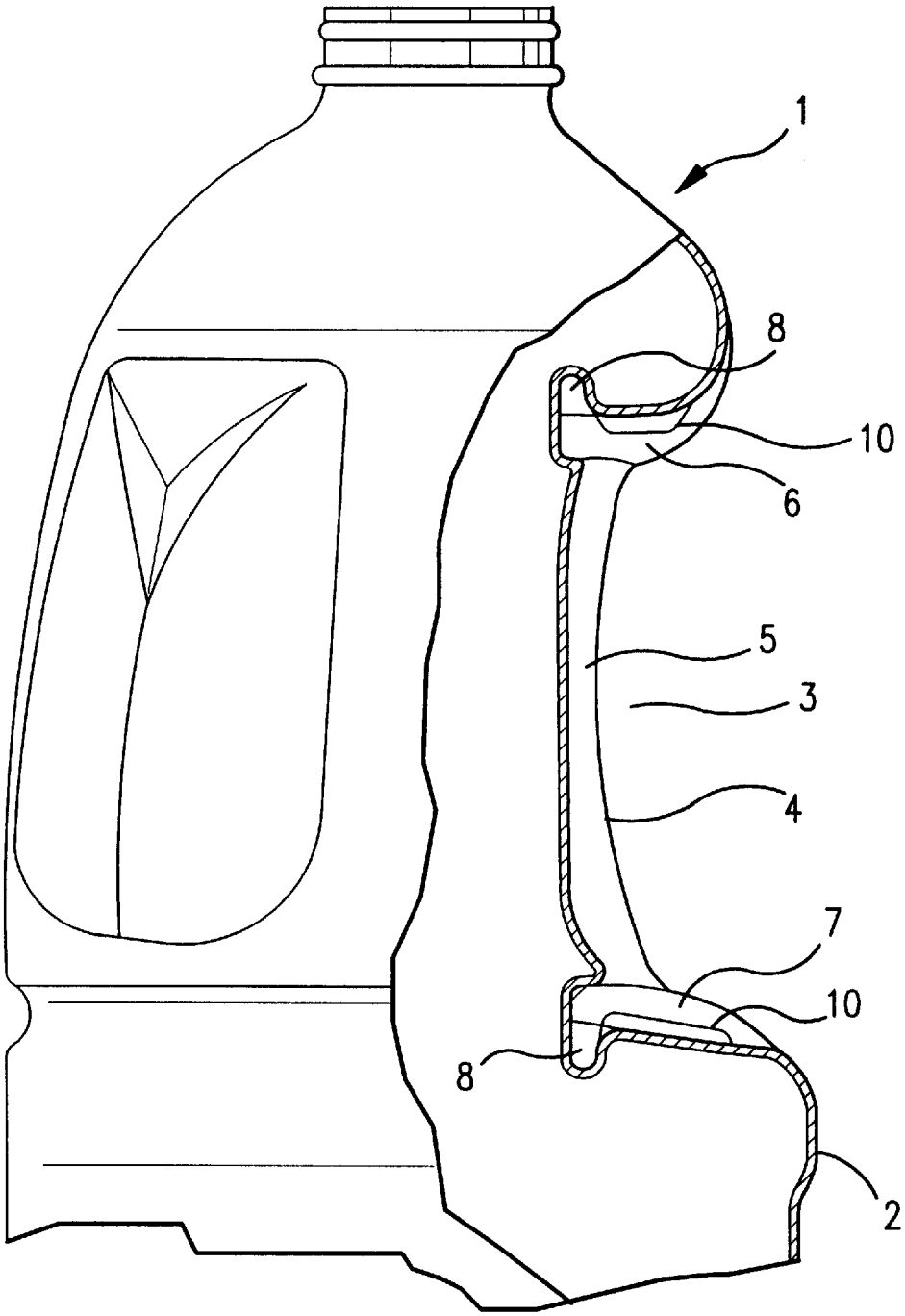
FIG. 2 is an enlarged partial sectional view of the bottle main body of the first embodiment of the invention.

FIG. 2 is a longitudinal cross sectional view of the recess 3 of the bottle main body 1 of the first embodiment. The recess 3 has an upper recess 6 at its upper portion and a lower recess 7 at its lower portion. Each of the upper recess 6 and the lower recess 7 is arranged substantially horizontally. The upper recess 6 opens to a backside and downside. The lower recess 7 opens to a backside and an upside. The recess 3 has a recess bottom 4 in which a central longitudinal groove 5 is formed between a front end portion of the upper recess 6 and a front end portion of the lower recess 7. The front end portion of the upper recess 6 Is provided with an upward engaging recess 8. The front end portion of the lower recess 7 is provided with a downward engaging recess 8.

Figure 3:
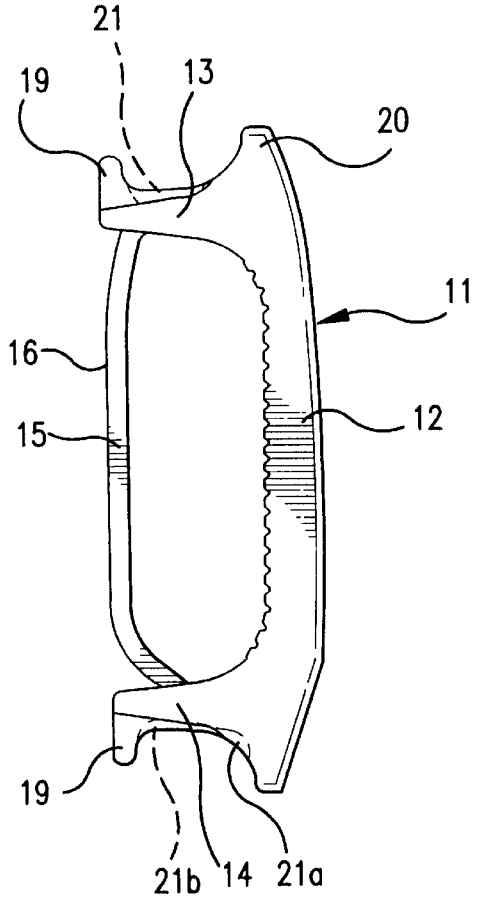
FIG. 3 is a schematic lateral view of a preferred embodiment of grip that can be used for the embodiment of FIG. 1.
Figure 4:
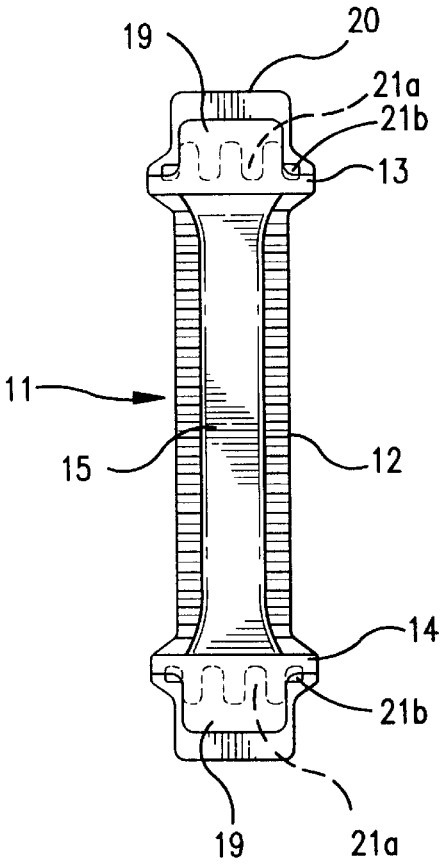
FIG. 4 is a schematic rear view of the embodiment of grip of FIG. 3 viewed from the front side of the bottle.

A grip 11 of hard synthetic resin formed by injection molding (see FIGS. 3 and 4) is designed to be secured to the bottle main body 1 of FIG. 2 and comprises an upper securing plate 13 to be received by the upper recess 6 for engagement, a lower securing plate 14 to be received by the lower recess 7 for engagement, a grip plate 12 connected between a rear end of the upper securing plate 13 and a rear end of the lower securing plate 14, and a securing beam plate 15 connected between the front end portion of the upper securing plate 13 and the front end portion of the lower securing plate 14. The securing beam plate 15 is so designed to be received by the central longitudinal groove 5. The front end portion of the upper securing plate 13 is provided with an upward projection 19 which engages with the upward engaged recess 8. The front end portion of the lower securing plate 14 is provided with a downward projection 19 which engages with the downward engaged recess 8.

Figure 12:
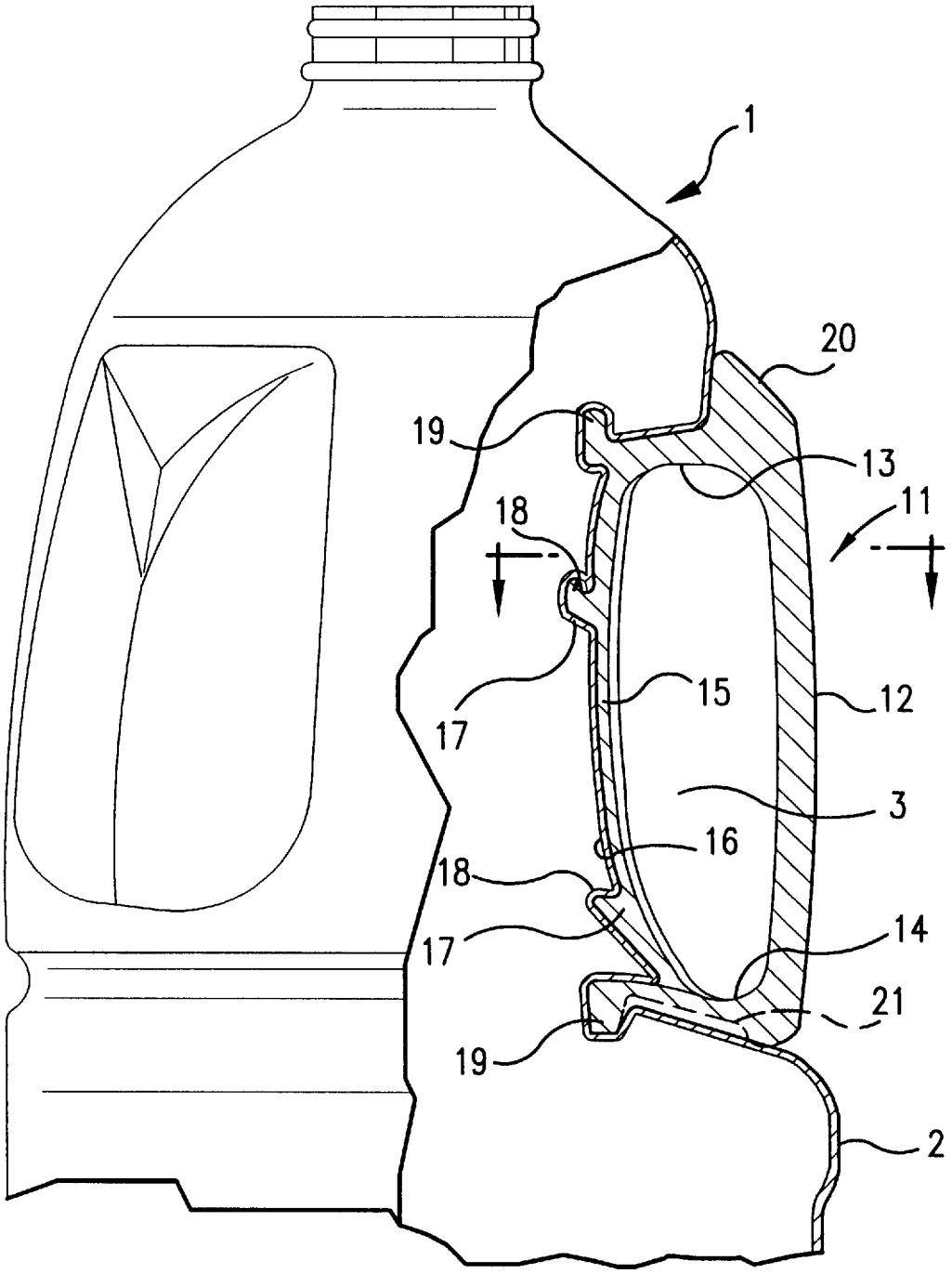
FIG. 12 is an enlarged partial sectional view of the bottle main body with a grip of the embodiment of FIG. 11.
Figure 13:
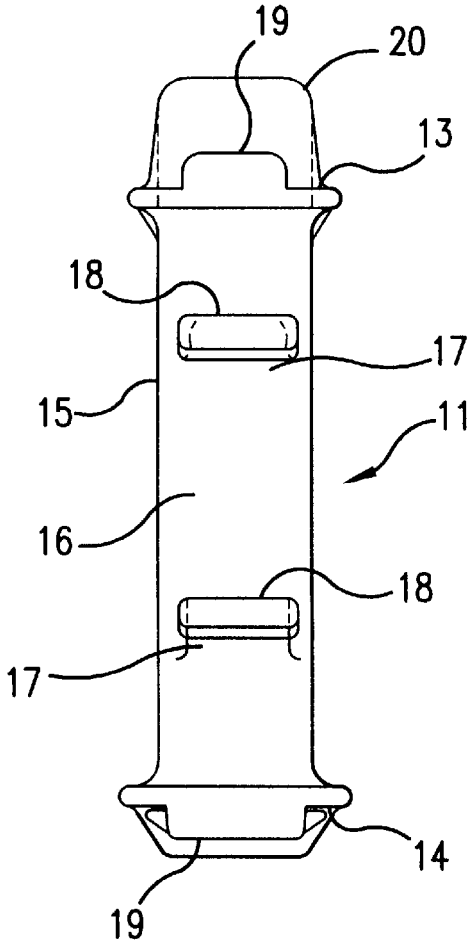
FIG. 13 is a schematic rear view of the embodiment of grip of FIG. 12 viewed from the front side of the bottle.
Figure 14:
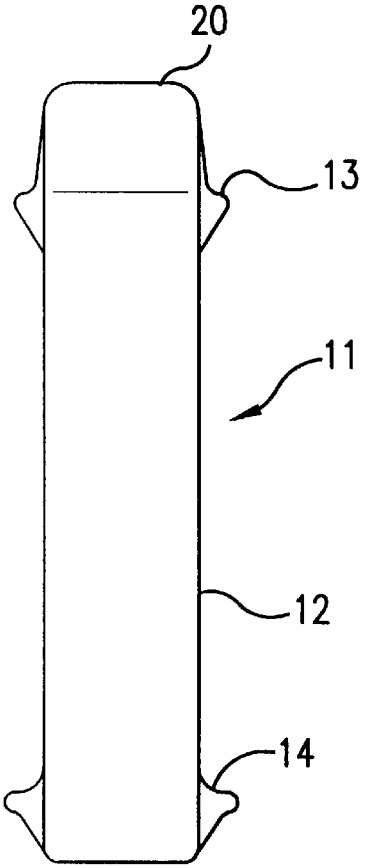
FIG. 14 is a schematic rear view of the embodiment of grip of FIG. 12.
Figure 15:
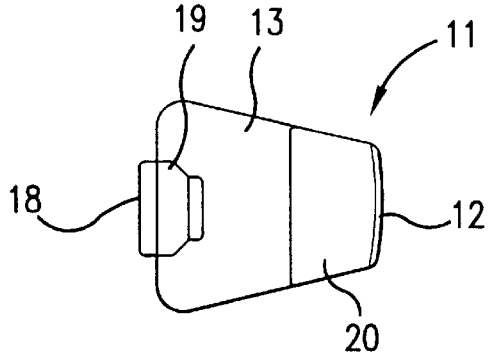
FIG. 15 is a schematic plan view of the embodiment of grip of FIG. 12.
Figure 16:
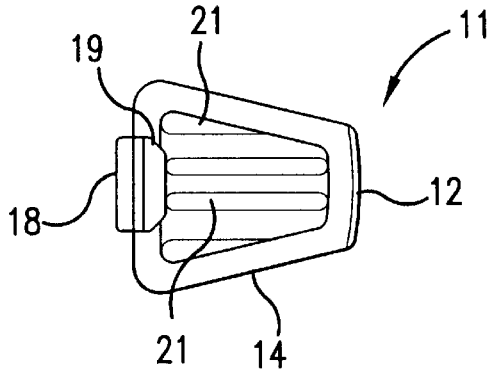
FIG. 16 is a schematic bottom view of the embodiment of grip of FIG. 12.
Figure 17:
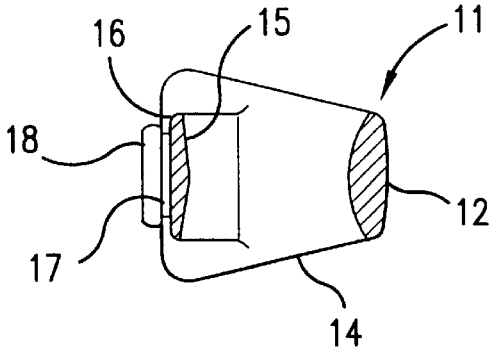
FIG. 17 is a schematic sectional plan view of the embodiment of grip of FIG. 12.

The grip 11 is additionally provided with an extension 20 extending upward from the grip plate 12 to abut the surface of the body section 2 of the bottle main body 1. The extension 20 is designed to minimize any possible flexural deformation of a portion of the bottle main body located between the extension 20 and the upward projection 19, and consequently to ensure a stable engagement between the upward projection 19 and the bottle main body 1 (more specifically the upper engaging recess 8 of the bottle main body 1) when the user picks up the bottle by holding the grip 11 with hand (see FIG. 12).

The upper securing plate 13 of the grip 11 is provided on the upper surface with a plurality of grooves 21 on a forward and backward direction. The lower securing plate 14 of the grip 11 is provided on the lower surface with a plurality of grooves 21 on a forward and backward direction. The upper recess 6 is provided with a ridge 10 on its surface. The lower recess 7 is provided with a ridge 10 on its surface. The ridges 10 are engaged with the respective grooves 21. In the Illustrated embodiment, two long grooves 21*a* and two short grooves 21*b* are provided.

Figure 18:
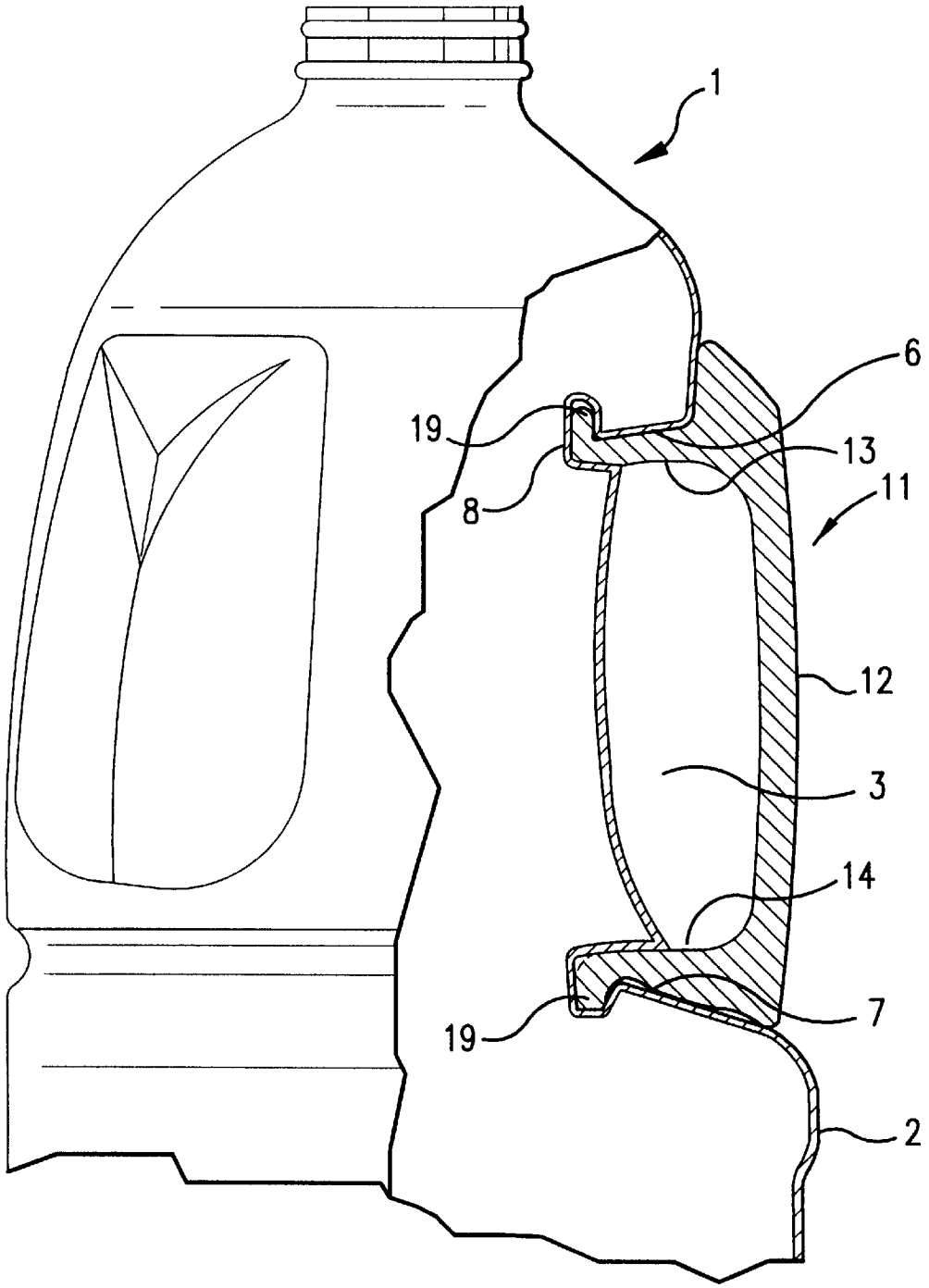
FIG.18 PRIOR ART
FIG. 18 is an enlarged partial sectional view of a prior art bottle.

Table 1 shows a result of an experiment conducted on the strength on sample bottles of the first embodiment and comparable prior art sample bottles as shown in FIG. 18, all the sample bottles having a capacity of 4 liters.

TABLE 1

| | Test Item Grip strength | | | | | |
|---|---|---|---|---|---|---|
| | tensile strength | | suspension impact | | flat fall | |
| sample bottle | (kgf) | | (cm) | | (cm) | |
| present invention | | | | | | |
| 1 | 81.7 | C | 55 | DC | 50 | D |
| 2 | 81.4 | C | 40 | DC | 110 | DB |
| 3 | 79.1 | C | 55 | C | 110 | D |
| 4 | | | | | 80 | D |
| 5 | | | | | 50 | D |
| average | 80.7 | C | 50 | DC | 80 | DB |
| Prior art (FIG. 18) | | | | | | |
| 1 | 57.5 | C | 40 | A | 30 | F |
| 2 | 56.2 | C | 35 | A | 40 | F |
| 3 | 43.0 | B | 45 | DA | 40 | F |
| 4 | | | | | 30 | F |
| 5 | | | | | 30 | F |
| average | 52.2 | CB | 40 | DA | 34 | F |

*Grip strength
<grip coming off>
A: lower portion came off
B: upper portion came off
C: whole came off
<grip cracking> D:
<bottle cracking>
E: lower portion horizontal cracking
F: lower portion upward cracking
G: bottom cracking
H: upper portion cracking As clearly seen from Table 1, in the flat fall rest, the bottle main bodies 1 according to the prior art produced cracks when dropped from an average height of 34 cm. On the other hand, according to the present invention, the grips 11 did not produce any cracks until they were dropped from an average height of 80 cm, and in addition, the bottle main bodies 1 did not show any cracks throughout the flat fall test. Additionally, the bottles according to the present invention showed a remarkable improvement in the tension strength and the suspension impact if compared with their counterparts of the bottles according to the prior art.

Figure 5:
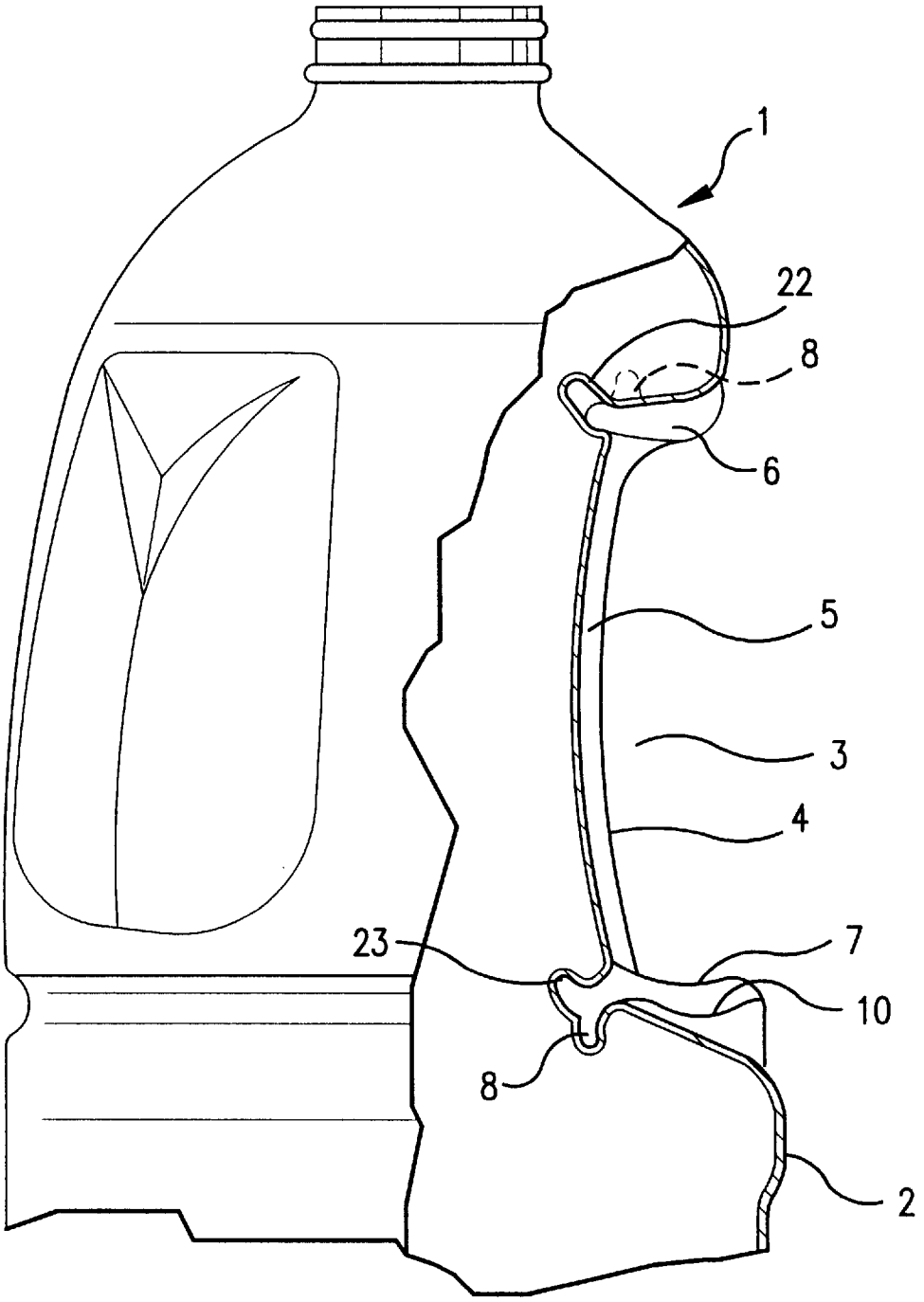
FIG. 5 is an enlarged partial sectional view of the bottle main body of a second embodiment of the invention.

FIG. 5 is a longitudinal cross sectional view of the recess 3 of the bottle main body 1 of a second embodiment of the invention. The front end portion of the upper recess 6 of the recess 3 is provided with an upward engaging recess 8. The front end of the upper recess 6 is provided with an upper engaging hole 22 facing forward and upward. The front end portion of the lower recess 7 of the recess 3 is provided with a downward engaging recess 8. The front end of the lower recess 7 is provided with a lower engaging hole 23 facing forward and downward.

Figure 6:
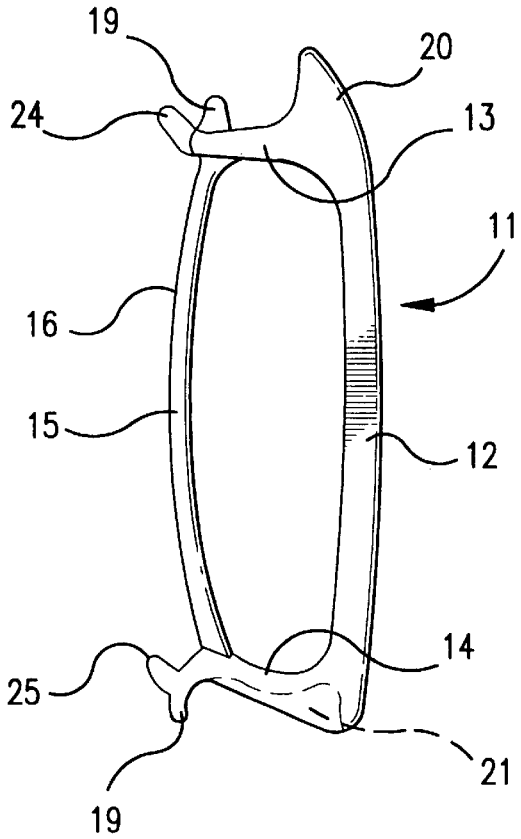
FIG. 6 is a schematic lateral view of a preferred embodiment of grip that can be used for the embodiment of FIG. 5.

In the grip 11 (see FIG. 6) to be secured to the bottle main body 1 of FIG. 5, the upper securing plate 13 is provided at the front end portion thereof with the upward projection 19 engaged with the engaging recess 8, and, in addition, provided at the front end with an upper angular piece 24 which projects upwardly, forwardly and obliquely and is engaged with the upper engaging hole 22. The lower securing plate 14 is provided at the front end portion thereof with the downward projection 19 engaged with the engaging recess 8, and, in addition, provided at the front end thereof with a lower angular piece 25 which projects forwardly, upwardly and obliquely and is engaged with the lower engaging hole 23.

In the grip 11 of the second embodiment, since the securing beam plate 15 is suspended between the front end portion of the upper securing plate 13 and the front end portion of the lower securing plate 14, the front ends of the upper and lower securing plates 13 and 14 carrying respectively the projections 19 and the upper and lower angular pieces 24 and 25 are located ahead of the securing beam plate 15. Thus, the projections 19 and the upper and lower angular pieces 24 and 25 are located deep in the bottle main body 1 so as to enhance the strength of engagement of the grip 11 and the bottle main body 1.

Figure 7:
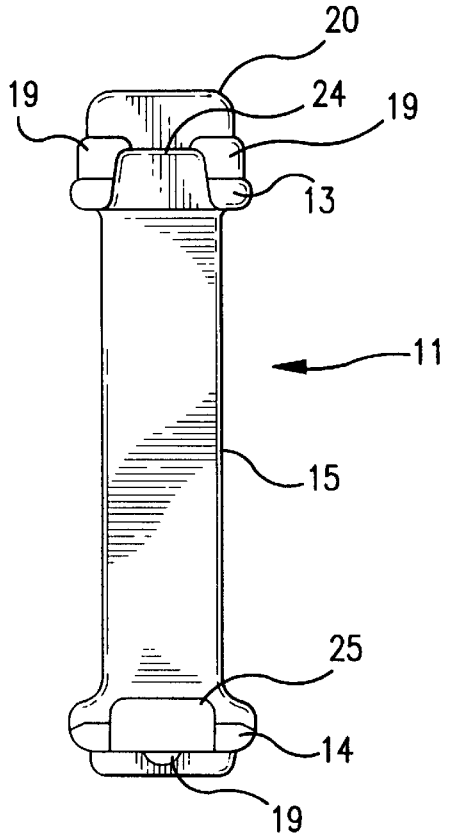
FIG. 7 is a schematic rear view of the embodiment of grip of FIG. 6 viewed from the front side of the bottle.
Figure 8:
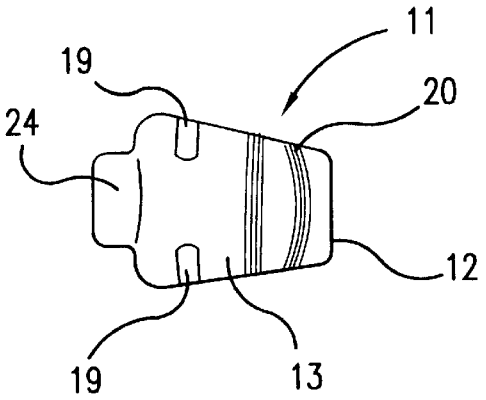
FIG. 8 is a schematic plan view of the embodiment of grip of FIG. 6.

FIGS. 7 and 8 illustrate an another embodiment. In this embodiment, the grip 11 includes the upper and lower angular pieces 24 and 25 in addition to the projection 19, and the projection 19 formed on the upper securing plate 13 is divided into two lateral parts. In other words, the upper securing plate 13 is provided with two upward projections 19 laterally provided or arranged. Each lateral edge of the two-part projection 19 is aligned with a corresponding lateral edge of the upper securing plate 13. The single upper angular piece 24 is projecting from the center of the front end of the upper securing plate 13. In this embodiment, the engaging recess 8 of the upper recess 6 is also divided into two lateral parts in correspondence to the projection 19.

Since the projection 19 divided into two parts Is projecting upward and since the upper angular piece 24 projecting forwardly, upwardly and obliquely is one piece, the two-part projection 19 of the grip 11 illustrated in FIGS. 7 and 8 can be molded in an upwardly open metal mold without enlarging the surface area of the metal mold for molding the grip 11 so that a large number of grips can be molded at a time by means of a dimensionally limited metal mold.

Figure 9:
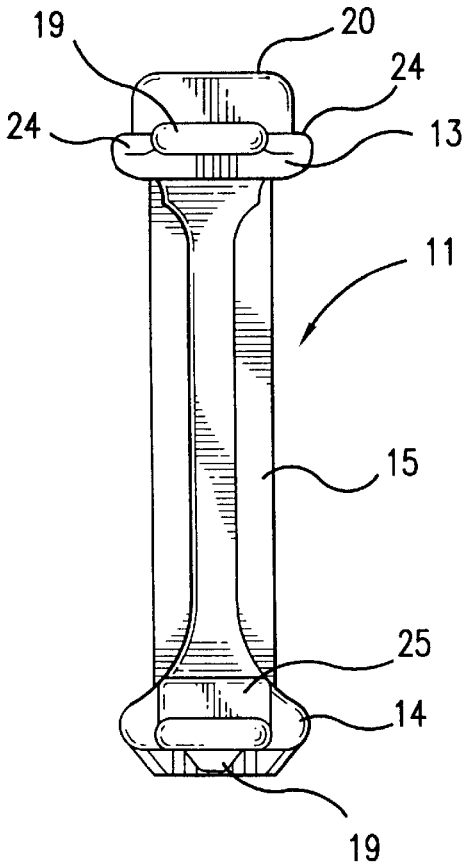
FIG. 9 is a schematic rear view of the further embodiment of grip viewed from the front side of the bottle.
Figure 10:
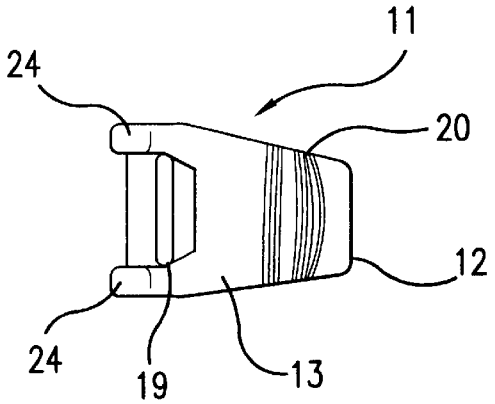
FIG. 10 is a schematic plan view of the embodiment of grip of FIG. 9.
Figure 11:
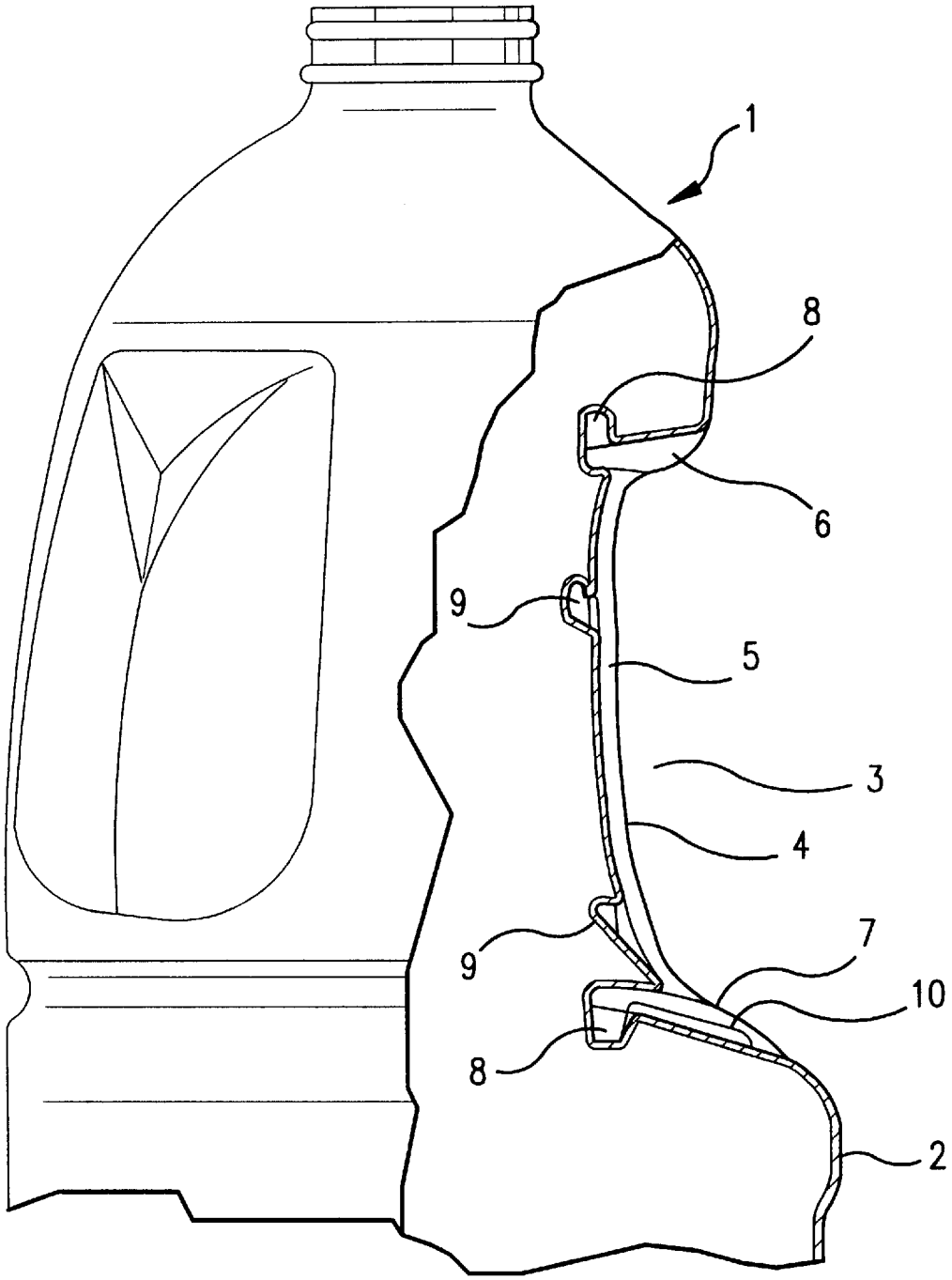
FIG. 11 is an enlarged partial sectional view of the bottle main body of a third embodiment of the invention.

FIGS. 9 and 10 illustrate another embodiment. In this embodiment, the grip 11 includes the upper and lower angular pieces 24 and 25 in addition to the projection 19, and the upper angular piece 24 is divided into two lateral parts. In other words, the upper securing plate 13 is provided with two upper angular pieces 24 laterally provided or arranged. Each of a lateral edge of the two-part upper angular piece 24 is aligned with a corresponding lateral edge of the upper securing plate 13. The single projection 19 is projecting from the center of the front end of the upper securing plate 13. In this embodiment, the engaging hole 22 of the upper recess 6 is also divided into two lateral parts in correspondence to the upper angular pieces 24.

Since the upper angular piece 24 divided into two parts is projecting forward from the front end of the upper securing plate 13, the upper securing plate 13 is engaged with the bottle main body 1 more effectively. However, since the upper angular piece 24 projecting forwardly, upwardly and obliquely is divided into two parts, the metal mold for molding the grip 11 is required to be capable of being opened along the direction of the upper angular piece 24 projecting forwardly, upwardly and obliquely in order to produce the upper angular piece 24. Thus, it is necessary to enlarge the surface area of the metal mold, so that the number of grips that can be molded at a time by means of a dimensionally limited metal mold is inevitably limited.

FIGS. 11 through 17 illustrate still another embodiment of bottle according to the invention. In this embodiment, a front surface 16 of the securing beam plate 15 is provided with engaging projections 17 having a bulged tip section 18 at the end thereof, in place of the upper and lower angular pieces 24 and 25. Two engaging projections 17 are projecting forwardly, upwardly and obliquely from the front surface 16 at positions close to the upper end and the lower end of the securing beam plate 15. The central longitudinal groove 5 of the bottle main body 1 is provided on the bottom with bulged engaging holes 9 for engagedly receiving the respective engaging projections 17.

Since the engaging projections 17 are unreleasably engaged with the respective engaging holes 9, the grip is unreleasably engaged with the bottle main body 1 not only by means of the upper and lower securing plates 13 and 14 but also by means of the securing beam plate 15. Thus, the grip 11 is evenly unreleasably secured to the bottle main body 1 substantially along the entire length of the grip 11. In addition, since the engaging projection 17 is directed forwardly, upwardly and obliquely, the load of the bottle main body is borne or supported not only by the upper securing plate 13 but also by the securing beam plate 15, the grip 11 can stably bear the load of the bottle main body 1.

The lower securing plate 14 of the grip 11 is provided on the lower surface thereof with a groove 21, which comes into engagement with the ridge 10 of the bottle main body 1. Because of the engagement of ridge 10 with the groove 21, the lower securing plate 14 is securely prevented from being laterally released from the lower recess 7 of the lower securing plate 14 when the user picks up the bottle main body 1, holding the grip 11 by hand. Furthermore, the ridge 10 operates as a reinforcing rib that prevents the bottom of the lower recess 7 from being subjected to flexural deformation to further enhance the stable engagement of the lower securing plate 14 and the bottle main body 1.

A synthetic resin bottle with a grip according to the Invention and having a configuration as described above has the following advantages. Since the securing beam plate is suspended between the front ends of the upper and lower securing plates to form an integral entity, the upper and lower securing plates are prevented from being deformed to change the distance between the front ends thereof so that, If the bottle is dropped with the grip facing downward, no abnormally strong pulling force is applied to the bottle main body by the grip if the bottle is subjected to impact and hence no cracks can be produced at portions of the bottle main body where the grip is secured to the bottle main body.

Additionally, since upward and downward projections are arranged respectively at the upper and lower ends of the grip, the grip can be secured to the bottle main body at the upper and lower ends so that, if the bottle main body is subjected to flexural deformation to some extent when the user is holding the grip by hand to handle the bottle, the grip remains strongly secured to the bottle main body and the strong engagement between the grip and the bottle main body is maintained.

Still additionally, since the securing beam plate is suspended between the upper and lower securing plates as described above, the upper and lower securing plates are prevented from being deformed to change the distance between them so that the upper and lower securing plates are held in stable engagement respectively with the upper and lower recesses and the intensity of engagement between the engaging recesses and the corresponding projections is maintained to keep the strong engagement between the grip and the bottle main body.

Still additionally, since the upper and lower securing plates of the grip are engaged respectively with the upper and lower recesses of the bottle main body and the securing beam plate of the grip is engaged with central longitudinal groove of the bottle main body, the grip is firmly secured to the bottle main body in such a way that the former is not laterally displaceable relative to the latter so that the user can securely handle the bottle by holding the grip in hand.

When the upper and lower securing plates of the grip are provided at the front ends thereof with respective upper and lower angular pieces projecting aslant forwardly and upwardly, the load of the bottle main body is borne by the upper and lower securing plates of the grip to stably support the bottle main body.

When the upper projection of the grip is divided into two lateral parts, the engagement of the two-part upper projection and the bottle main body is intensified and becomes more stable and the metal mold for injection-molding the grip can be so designed as to be able to produce a large number of grips at a time and hence improve the productivity.

When the upper angular piece of the grip is divided into two lateral parts, the grip is securely engaged with the bottle main body by means of the upper angular piece because the upper angular piece is located at the front end of the upper securing plate so that consequently the engagement between the grip and the bottle main body is stably maintained.

When the engaging projections are formed on the securing beam plate to become engaged with the corresponding engaging recesses, the grip is also secured to the bottle main body between the upper and lower projections so that the grip is engaged with the bottle main body along the entire length of the grip to further improve the stable engagement between the grip and the bottle main body.

What is claimed is:

1. A synthetic resin bottle-shaped container with a grip, comprising a biaxially oriented blow-molded bottle main body made of synthetic resin and a grip, wherein said bottle main body has a body section, said body section includes a recess formed by indenting a rear side of the body section, said grip comprises an upper securing plate secured to an upper portion of the recess, a lower securing plate spaced a predetermined longitudinal distance from the upper securing plate and secured to a lower portion of the recess, a grip plate connecting a rear end of the upper securing plate at an upper end thereof and a rear end of the lower securing plate at a lower end thereof, and a securing beam plate provided between a front end portion of the upper securing plate and a front end portion of the lower securing plate, the securing beam plate substantially maintaining the predetermined longitudinal distance between the upper and lower securing plates during application of an impact force directed against the grip plate, the front end portion of the upper securing plate is provided with an upward projection, the front end portion of the lower securing plate is provided with a downward projection, the bottle main body is provided with an upper recess into which the upper securing plate is inserted, a lower recess into which the lower securing plate is inserted, and a central longitudinal groove engaged with the securing beam plate, said upper recess is provided with an upward engaging recess for engagedly receiving said upward projection, and said lower recess is provided with a downward engaging recess for engagedly receiving said downward projection.

2. A synthetic resin bottle with a grip according to claim 1, wherein the front end portion of the upper securing plate and that of the lower securing plate of the grip are located ahead of a connecting portion of the securing beam plate.

3. A synthetic resin bottle with a grip according to claim 2, wherein at least one of the lower securing plate and the upper securing plate is provided with a surface thereof including a plurality of grooves extending forwardly and rearwardly, and a surface of at least one of the upper recess and the lower recess of the bottle main body is provided with ridges for engagement with said grooves.

4. A synthetic resin bottle with a grip according to claim 1, wherein at least one of the lower securing plate and the upper securing plate is provided with a surface thereof including a plurality of grooves extending forwardly and rearwardly, and a surface of at least one of the upper recess and the lower recess of the bottle main body is provided with ridges for engagement with said grooves.

5. A synthetic resin bottle-shaped container with a grip, comprising a biaxially oriented blow-molded bottle main body made of synthetic resin and a grip, wherein said bottle main body has a body section, said body section includes a recess formed by indenting a rear side of the body section, said grip comprises an upper securing plate secured to an upper portion of the recess, a lower securing plate spaced a predetermined longitudinal distance from the upper securing plate and secured to a lower portion of the recess, a grip plate connecting a rear end of the upper securing plate at an upper end thereof and a rear end of the lower securing plate at a lower end thereof, and a securing beam plate provided between a front end portion of the upper securing plate and a front end portion of the lower securing plate, the securing beam plate substantially maintaining the predetermined longitudinal distance between the upper and lower securing plates during application of an impact force directed against the grip plate, the front end portion of the upper securing plate is provided with at least one upward projection, the front end portion of the upper securing plate is provided with at least one upper angular piece upwardly, forwardly and obliquely projected, the front end portion of the lower securing plate is provided with at least one downward projection, the front end of the lower securing plate is provided with at least one lower angular piece upwardly, forwardly and obliquely projected, the bottle main body is provided with an upper recess into which the upper securing plate is inserted, a lower recess into which the lower securing plate is inserted, and a central longitudinal groove engaged with the securing beam plate, said upper recess is provided with an upward engaging recess for engagedly receiving said upward projection, and an upper engaging hole for engaging the upper angular piece, said upper engaging hole being upwardly, forwardly and obliquely directed, and said lower recess is provided with a downward engaging recess for engagedly receiving said downward projection, and a lower engaging hole for engaging the lower angular piece, said lower engaging hole being upwardly, forwardly and obliquely directed.

6. A synthetic resin bottle with a grip according to claim 5, wherein the front end portion of the upper securing plate and that of the lower securing plate of the grip are located ahead of a connecting portion of the securing beam plate.

7. A synthetic resin bottle with a grip according to claim 5, wherein at least one of the lower securing plate and the upper securing plate is provided with a surface thereof including a plurality of grooves extending forwardly and rearwardly, and a surface of at least one of the upper recess and the lower recess of the bottle main body is provided with ridges for engagement with said grooves.

8. A synthetic resin bottle with a grip according to claim 5, wherein said at least one upward projection comprises at least two upward projections, one of said two upward projections being provided on each lateral side of the upper angular piece, said at least one downward projection comprises two downward projections, one of said two downward projections being provided on each lateral side of the lower angular piece, and said upward engaging recess and said downward engaging recess, respectively, are structured to receive the upward and downward projections.

9. A synthetic resin bottle with a grip according to claim 5, wherein said at least one upper angular piece comprises at least two upper angular pieces, one of said two upper angular pieces being provided on each lateral side of the upward projection, said at least one lower angular piece comprises at least two lower angular pieces, one of said two lower angular pieces being provided on each lateral side of the downward projection, and said upper and lower engaging holes, respectively, are structured to receive the upper and lower angular pieces.

10. A synthetic resin bottle-shaped container with a grip, comprising a biaxially oriented blow-molded bottle main body made of synthetic resin and a grip, wherein said bottle main body has a body section, said body section includes a main recess formed by indenting a rear side of the body section, said grip comprises an upper securing plate secured to an upper portion of the recess, a lower securing plate secured to a lower portion of the recess, and a grip plate connecting a rear end of the upper securing plate at an upper end thereof and a rear end of the lower securing plate at a lower end thereof, a front end portion of the upper securing plate is provided with at least one upward projection, a front end portion of the lower securing plate is provided with at least one downward projection, the front end of the lower securing plate is provided with at least one lower angular piece upwardly, forwardly and obliquely projected with respect to the main recess, the bottle main body is provided with an upper recess into which the upper securing plate is inserted, and a lower recess into which the lower securing plate is inserted, said upper recess is provided with an upward engaging recess for engagedly receiving said upward projection, and said lower recess is provided with a downward engaging recess for engagedly receiving said downward projection, and a lower engaging hole for engaging the lower angular piece, said lower engaging hole being upwardly, forwardly and obliquely directed with respect to the main recess.

11. A synthetic resin bottle with a grip according to claim 10, further comprising a securing beam plate provided between the front end portion of the upper securing plate and the front end portion of the lower securing plate.

12. A synthetic resin bottle with a grip according to claim 11, wherein the front end portion of the upper securing plate and that of the lower securing plate of the grip are located ahead of a connecting portion of the securing beam plate.

13. A synthetic resin bottle with a grip according to claim 12, wherein at least one of the lower securing plate and the upper securing plate is provided with a surface thereof including a plurality of grooves extending forwardly and rearwardly, and a surface of at least one of the upper recess and the lower recess of the bottle main body is provided with ridges for engagement with said grooves.

14. A synthetic resin bottle with a grip according to claim 11, wherein at least one of the lower securing plate and the upper securing plate is provided with a surface thereof including a plurality of grooves extending forwardly and rearwardly, and a surface of at least one of the upper recess and the lower recess of the bottle main body is provided with ridges for engagement with said grooves.

15. A synthetic resin bottle with a grip according to claim 11, further comprising engaging projections formed on a front surface of the securing beam plate, and engaging holes formed in the recess for receiving the engaging projections.

16. A synthetic resin bottle with a grip according to claim 10 wherein the front end portion of the upper securing plate is provided with at least one upper angular piece upwardly, forwardly and obliquely projected, and the upper recess is provided with an upper engaging hole for engaging the upper angular piece, the upper engaging hole being upwardly, forwardly and obliquely directed.

17. A synthetic resin bottle with a grip according to claim 16, wherein said at least one upward projection comprises at least two upward projections, one of said two upward projections being provided on each lateral side of the upper angular piece, said at least one downward projection comprises two downward projections, one of said two downward projections being provided on each lateral side of the lower angular piece, and said upward engaging recess and said downward engaging recess, respectively, are structured to receive the upward and downward projections.

18. A synthetic resin bottle with a grip according to claim 16, wherein said at least one upper angular piece comprises at least two upper angular pieces, one of said two upper angular pieces being provided on each lateral side of the upward projection, said at least one lower angular piece comprises at least two lower angular pieces, one of said two lower angular pieces being provided on each lateral side of the downward projection, and said upper and lower engaging holes, respectively, are structured to receive the upper and lower angular pieces.

19. A synthetic resin bottle with a grip according to claim 10, wherein said downward projection and said lower angular piece are integrally formed.

20. A synthetic resin bottle with a grip according to claim 10, wherein said lower securing plate includes an extension on which said downward projection and said lower angular piece are integrally formed.

21. A synthetic resin bottle with a grip according to claim 10, wherein said downward projection and said lower angular piece extend in substantially opposite directions.

22. A synthetic resin bottle with a grip according to claim 10, wherein said downward projection and said lower angular piece are formed deep within the recess of the body section.

23. A synthetic resin bottle with a grip according to claim 10, wherein said upper and lower recesses and said lower engaging hole are located forward of the main recess toward a central longitudinal axis of the bottle main body.

24. A synthetic resin bottle-shaped container with a grip, comprising a biaxially oriented blow-molded bottle main body made of synthetic resin and a grip, wherein said bottle main body has a body section, said body section includes a recess formed by indenting a rear side of the body section, said grip comprises an upper securing plate secured to an upper portion of the recess, a lower securing plate secured to a lower portion of the recess, a grip plate connecting a rear end of the upper securing plate at an upper end thereof and a rear end of the lower securing plate at a lower end thereof, and a securing beam plate provided between a front end portion of the upper securing plate and a front end portion of the lower securing plate, wherein at least one of the front end portion of the upper securing plate and that of the lower securing plate is located ahead of a connection portion of the securing beam plate, the front end portion of the upper securing plate is provided with an upward projection, the front end of the upper securing plate is provided with two upper angular pieces laterally provided, said upper angular pieces being upwardly, forwardly and obliquely directed, the front end portion of the lower securing plate is provided with a downward projection, the front end of the lower securing plate is provided with a lower angular piece directed upwardly, forwardly and obliquely, the bottle main body is provided with an upper recess into which the upper securing plate is inserted, a lower recess into which the lower securing plate is inserted, and a central longitudinal groove engaged with the securing beam plate, said upper recess is provided with an upward engaging recess for engagedly receiving said upward projection, and upper engaging holes for engagedly receiving said two upper angular pieces laterally provided, said upper engaging holes being upwardly, forwardly and obliquely directed, and said lower recess is provided with a downward engaging recess for engagedly receiving said downward projection, and a lower engaging hole for engagedly receiving said lower angular piece, said lower engaging hole being upwardly, forwardly and obliquely directed.

25. A synthetic resin bottle with a grip according to claim 24, wherein the front end portion of the upper securing plate and that of the lower securing plate of the grip are located ahead of a connecting portion of the securing beam plate.

26. A synthetic resin bottle with a grip according to claim 24, wherein at least one of the lower securing plate and the upper securing plate is provided with a surface thereof including a plurality of grooves extending forwardly and rearwardly, and a surface of at least one of the upper recess and lower recess of the bottle main body is provided with ridges for engagement with said grooves.

27. A synthetic resin bottle-shaped container with a grip, comprising a biaxially oriented blow-molded bottle main body made of synthetic resin and a grip, wherein said bottle main body has a body section, said body section includes a recess formed by indenting a rear side of the body section, said grip comprises an upper securing plate secured to an upper portion of the recess, a lower securing plate secured to a lower portion of the recess, a grip plate connecting a rear end of the upper securing plate at an upper end thereof and a rear end of the lower securing plate at a lower end thereof, and a securing beam plate provided between a front end portion of the upper securing plate and a front end portion of the lower securing plate, wherein at least one of the front end portion of the upper securing plate and that of the lower securing plate is located ahead of a connection portion of the securing beam plate, the front end portion of the lower securing plate is provided with an upward projection, the front end portion of the lower securing plate is provided with a downward projection, a front surface of the securing beam plate is provided with an engaging projection having a bulged tip section at an end thereof, the bottle main body is provided with an upper recess into which the upper securing plate is inserted, a lower recess into which the lower securing plate is inserted, and a central longitudinal groove engaged with the securing beam plate, said upper recess is provided with an upward engaging recess for engagedly receiving said upward projection, said lower recess is provided with a downward engaging recess for engagedly receiving said downward projection, and said central longitudinal groove is provided with an engaging hole for engagedly receiving said engaging projection.

28. A synthetic resin bottle with a grip according to claim 27, wherein the engaging projection of the grip is inclined frontwardly and upwardly.

29. A synthetic resin bottle with a grip according to claim 28, wherein the front end portion of the upper securing plate and that of the lower securing plate of the grip are located ahead of a connecting portion of the securing beam plate.

30. A synthetic resin bottle with a grip according to claim 28, wherein at least the lower securing plate of the upper securing plate and the lower securing plate of the grip is provided on a lower surface thereof with a plurality of grooves extending forwardly and rearwardly, and the lower recess of the bottle main body is provided on a bottom surface thereof with ridges for engagement with said grooves.

31. A synthetic resin bottle with a grip according to claim 27, wherein the front end portion of the upper securing plate and that of the lower securing plate of the grip are located ahead of a connecting portion of the securing beam plate.

32. A synthetic resin bottle with a grip according to claim 27, wherein at least the lower securing plate of the upper securing plate and the lower securing plate of the grip is provided on a lower surface thereof with a plurality of grooves extending forwardly and rearwardly, and the lower recess of the bottle main body is provided on a bottom surface thereof with ridges for engagement with said grooves.

* * * * *